US008042717B2

(12) United States Patent
Lam et al.

(10) Patent No.: US 8,042,717 B2
(45) Date of Patent: Oct. 25, 2011

(54) FASTENER DRIVING DEVICE WITH CONTACT TRIP HAVING AN ELECTRICAL ACTUATOR

(75) Inventors: Lok C. Lam, Warwick, RI (US); Keven E. Miller, Wyoming, RI (US); David M. McGee, Attleboro, MA (US)

(73) Assignee: Stanley Fastening Systems, LP, East Greenwich, RI (US)

( * ) Notice: Subject to any disclaimer, the term of this patent is extended or adjusted under 35 U.S.C. 154(b) by 239 days.

(21) Appl. No.: 12/422,321

(22) Filed: Apr. 13, 2009

(65) Prior Publication Data

US 2010/0258607 A1 Oct. 14, 2010

(51) Int. Cl.
*B25C 1/08* (2006.01)

(52) U.S. Cl. ..... 227/7; 227/8; 227/131; 227/120; 227/4; 227/5; 227/6

(58) Field of Classification Search ..... 227/8, 131, 227/120, 4, 5, 6, 7
See application file for complete search history.

(56) References Cited

U.S. PATENT DOCUMENTS 4,403,722 A * 9/1983 Nikolich ..... 227/8
4,679,719 A 7/1987 Kramer ..... 227/5
4,811,881 A * 3/1989 Heck ..... 227/4
4,928,868 A * 5/1990 Kerrigan ..... 227/131
5,605,268 A * 2/1997 Hayashi et al. ..... 227/8
5,732,870 A 3/1998 Moorman et al. ..... 227/130
5,918,788 A 7/1999 Moorman et al. ..... 227/8
5,927,585 A * 7/1999 Moorman et al. ..... 227/132
6,382,492 B1 5/2002 Moorman et al. ..... 227/8
6,394,332 B2 5/2002 Akiba ..... 227/8
6,431,425 B1 8/2002 Moorman et al. ..... 227/8
6,641,018 B2 11/2003 Akiba ..... 227/8
6,789,718 B2 * 9/2004 Canlas et al. ..... 227/130
6,820,788 B2 11/2004 Akiba ..... 227/8
7,137,541 B2 * 11/2006 Baskar et al. ..... 227/120
7,143,918 B2 * 12/2006 Aguirre et al. ..... 227/8
7,175,063 B2 * 2/2007 Osuga et al. ..... 227/8
7,213,732 B2 5/2007 Schell et al. ..... 227/8
7,322,426 B2 * 1/2008 Aguirre et al. ..... 173/1
7,334,715 B2 2/2008 Oda et al. ..... 227/2
7,469,811 B2 12/2008 Shima et al. ..... 227/131
7,575,141 B1 * 8/2009 Liang et al. ..... 227/131
2004/0050899 A1 * 3/2004 Canlas et al. ..... 227/119
2005/0023318 A1 * 2/2005 Aguirre et al. ..... 227/8
2005/0139628 A1 * 6/2005 Aguirre et al. ..... 227/8
2006/0091177 A1 * 5/2006 Cannaliato et al. ..... 227/8
2006/0255086 A1 * 11/2006 Aguirre et al. ..... 227/8
2007/0075113 A1 4/2007 Tillinghast et al. ..... 227/130
2007/0095875 A1 5/2007 Lamb ..... 227/8
2007/0210134 A1 * 9/2007 Oda et al. ..... 227/131
2007/0215665 A1 9/2007 Ohmori ..... 227/8
2007/0221698 A1 * 9/2007 St. John et al. ..... 227/131

(Continued)

*Primary Examiner* — Brian D Nash
(74) *Attorney, Agent, or Firm* — Pillsbury Winthrop Shaw Pittman LLP

(57) ABSTRACT

A fastener driving device includes a housing, and a nose assembly carried by the housing. The nose assembly has a fastener drive track. The fastener driving device also includes an engine carried by the housing and configured to drive a fastener out of the drive track and into a workpiece during a drive stroke, a contact trip that includes an electrical actuator constructed and arranged to move a portion of contact trip to sense whether the workpiece is in front of the nose assembly, and a trigger configured to activate the electrical actuator to move the portion of the contact trip.

14 Claims, 10 Drawing Sheets

U.S. PATENT DOCUMENTS

| | | | | |
|---|---|---|---|---|
| 2007/0272422 | A1* | 11/2007 | Coleman | 173/1 |
| 2008/0067213 | A1 | 3/2008 | Shima et al. | 227/129 |
| 2008/0099525 | A1 | 5/2008 | Brendel et al. | 227/8 |
| 2008/0179371 | A1 | 7/2008 | Gardner et al. | 227/1 |
| 2008/0197165 | A1 | 8/2008 | Chen et al. | 227/8 |
| 2008/0223898 | A1 | 9/2008 | Rouger et al. | 227/8 |
| 2008/0290129 | A1 | 11/2008 | Schell et al. | 227/8 |
| 2008/0308592 | A1 | 12/2008 | Schell et al. | 227/8 |
| 2009/0020583 | A1 | 1/2009 | Kestner et al. | 227/130 |
| 2009/0032567 | A1* | 2/2009 | Liang et al. | 227/131 |
| 2010/0089963 | A1* | 4/2010 | Franz et al. | 227/8 |

* cited by examiner

FASTENER DRIVING DEVICE WITH CONTACT TRIP HAVING AN ELECTRICAL ACTUATOR

BACKGROUND OF THE INVENTION

1. Field of the Invention

The present invention generally relates to fastener driving devices, and more specifically relates to fastener driving devices that drive fasteners for connecting metal connectors to a workpiece.

2. Description of Related Art

The construction industry has seen an increase in the use of metal connectors when joining two workpieces together. For example, joist hangers are commonly used in the construction of floors in buildings, as well as outdoor decks. Also, L-shaped metal connectors are used to connect and/or reinforce two workpieces that are joined perpendicularly, such as when connecting the framing of two walls. Conventional fastener driving devices, such as pneumatic nailers, have been difficult to use in metal connector applications because the design of conventional pneumatic nailers makes it difficult to accurately locate a fastener into the hole of the metal connector due to design of the nose and the contact arm. A conventional contact arm is biased to extend past the nose of the nailer so that when the contact arm is pressed against the workpiece, the contact arm cooperates with the trigger to cause the nailer to actuate and drive the fastener into the workpiece. In many applications, such as framing and finishing, the fastener may be located in a range of locations, i.e. the precise location of the fastener may not be important. Conversely, when driving a fastener through a hole of a metal connector, the precision of the drive is important because of the risk of damaging the nailer or the metal connector. Although there have been attempts to use the tip of the fastener that is about to be driven as the hole locator, providing a robust and relatively inexpensive contact arm has been challenging.

BRIEF SUMMARY OF THE INVENTION

Therefore, it is an aspect of the present invention to provide a fastener driving device that allows the tip of a fastener to be used to locate a hole in a metal connector and has the safety features of a conventional fastener driving device.

An aspect of an embodiment of the present invention is to provide a fastener driving device includes a housing, and a nose assembly carried by the housing. The nose assembly has a fastener drive track. The fastener driving device also includes an engine carried by the housing and configured to drive a fastener out of the drive track and into a workpiece during a drive stroke, a contact trip that includes an electrical actuator constructed and arranged to move a portion of contact trip to sense whether the workpiece is in front of the nose assembly, and a trigger configured to activate the electrical actuator to move the portion of the contact trip.

Another aspect of an embodiment of the present invention is to provide a method of controlling the operation of a fastener driving device using a controller. The method includes receiving, by the controller, a signal from a trigger of the fastener driving device if the trigger is actuated; sending, by the controller, a signal to an electrical actuator of the fastener driving device to move a contact trip of the fastener driving device if the trigger is actuated; receiving, by the controller, a signal from a trip switch of the fastener driving device if the trip switch senses that a workpiece is in front of a nose assembly of the fastener driving device, and sending, by the controller, a signal to an engine of the fastener driving device to initiate a drive stroke if the controller receives a signal from the trigger and receives a signal from the trip switch.

Another aspect of an embodiment of the present invention is to provide a method of operating a fastener driving device. The method includes determining whether a trigger of the fastener device is actuated; actuating an electrical actuator of the fastener driving device to move a contact trip of the fastener driving device if the trigger is actuated; determining whether a trip switch of the fastener driving device is activated; and initiating a fastener drive stroke if the trip switch is activated.

These and other aspects, features, and advantages of the invention will become apparent from the following detailed description when taken in conjunction with the accompanying drawings, which are part of this disclosure and which illustrate, by way of example, the principles of this invention.

BRIEF DESCRIPTION OF THE DRAWINGS

Features of the invention are shown in the drawings, in which like reference numerals designate like elements. The drawings form part of this original disclosure, in which.

DETAILED DESCRIPTION OF THE INVENTION

Figure 1:
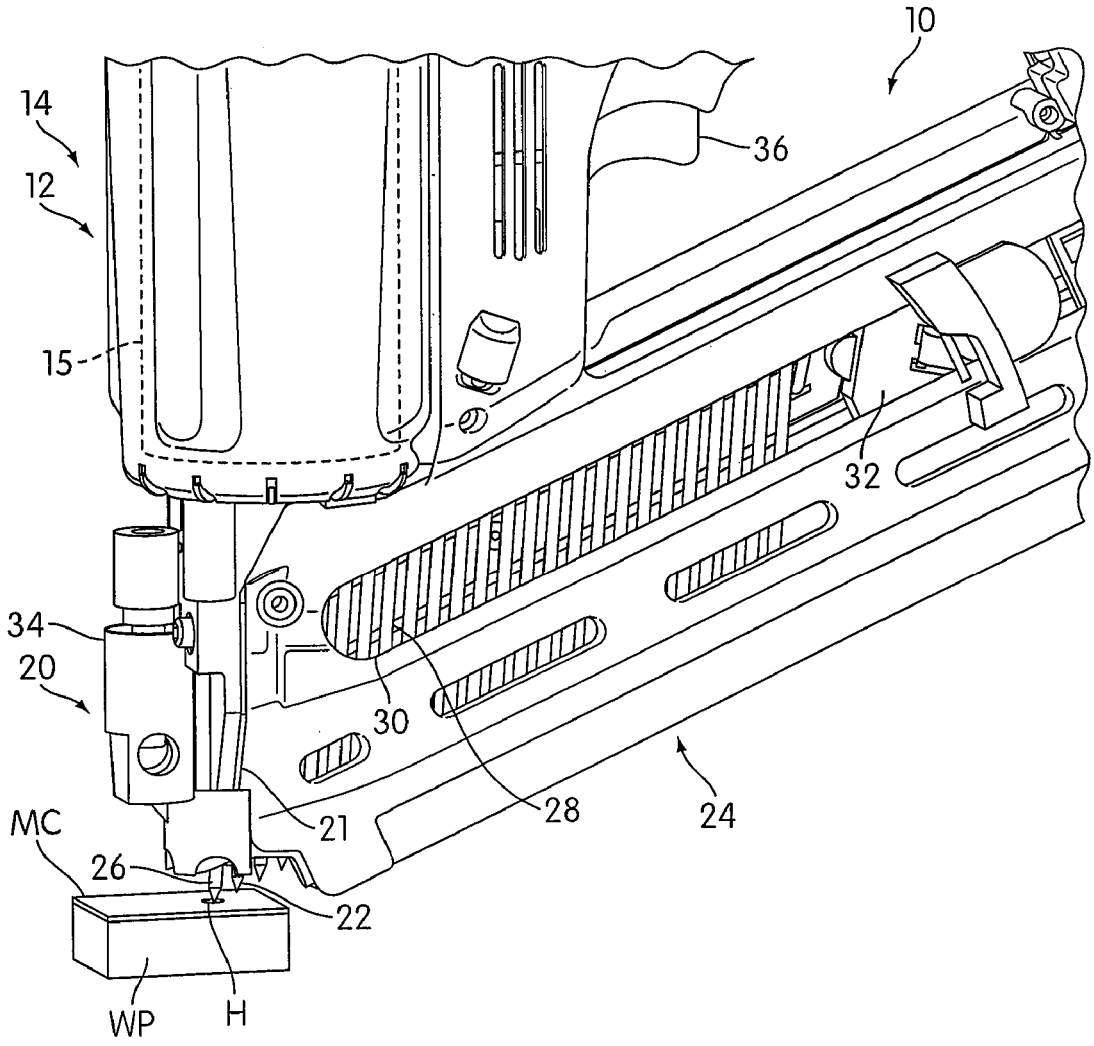
FIG. 1 is a side view of a fastener driving device, according to an embodiment of the present invention.

FIG. 1 illustrates a fastener driving device 10 according to an embodiment of the present invention. The device 10 includes a housing 12. The housing 12 is preferably constructed from a lightweight yet durable material, such as magnesium. The housing 12 includes an engine receiving portion 14 configured to contain an engine 15 that is constructed and arranged to drive a fastener into a workpiece WP. The engine 15 may be any suitable engine for driving a fastener into a workpiece WP that converts stored energy into kinetic energy to drive a fastener. For example, the engine may be a pneumatic-type engine that is powered by compressed air, or the engine may be powered by a battery, chemical reaction, etc., as is known in the art. Embodiments of the present invention are not limited to any specific type of engine.

The device 10 also includes a nose assembly 20 that is connected to the housing 12. The nose assembly 20 defines a fastener drive track 22 therein. A magazine assembly 24 is constructed and arranged to feed successive leading fasteners 26 from a supply of fasteners 28 contained therein along a feed track 30 and into the drive track 22. The supply of fasteners 28 is urged toward the drive track 22 with a pusher 32 that is biased towards the drive track 22 and engages the last fastener in the supply of fasteners 28. The magazine assembly 24 is preferably constructed and arranged to supply fasteners 24 that are specifically designed for connecting a metal connector MC with a workpiece WP. That is, the shank diameter of each fastener is sized to pass through a hole H in the metal connector MC, and the head of the fastener is sized to prevent the fastener from passing entirely through the hole H so that the metal connector MC may be fixedly secured to the workpiece WP.

The arrangement of the magazine assembly 24 illustrated in FIG. 1 allows for a compact and lightweight device 10. In one embodiment, one end of the magazine assembly 24 is preferably connected to a fixed portion 21 of the nose assembly 20 by known methods. Although the illustrated magazine assembly 24 is configured to receive fasteners that are collated in a stick configuration, it is also contemplated that a magazine assembly that is configured to accommodate fasteners that are collated in a coil may also be used. The illustrated embodiment is not intended to be limiting in any way.

The nose assembly 20 includes a contact trip assembly 34. The contact trip assembly 34 is in communication with a controller (not shown) which communicates with the engine 15 of the fastener device 10. The fastener device 10 further includes a trigger 36 which is also in communication with the controller. Upon receiving a signal from the trigger 36, and the contact trip assembly 34, the controller signals the engine 15 to initiate a drive stroke, as discussed in further detail below.

Figure 2A:
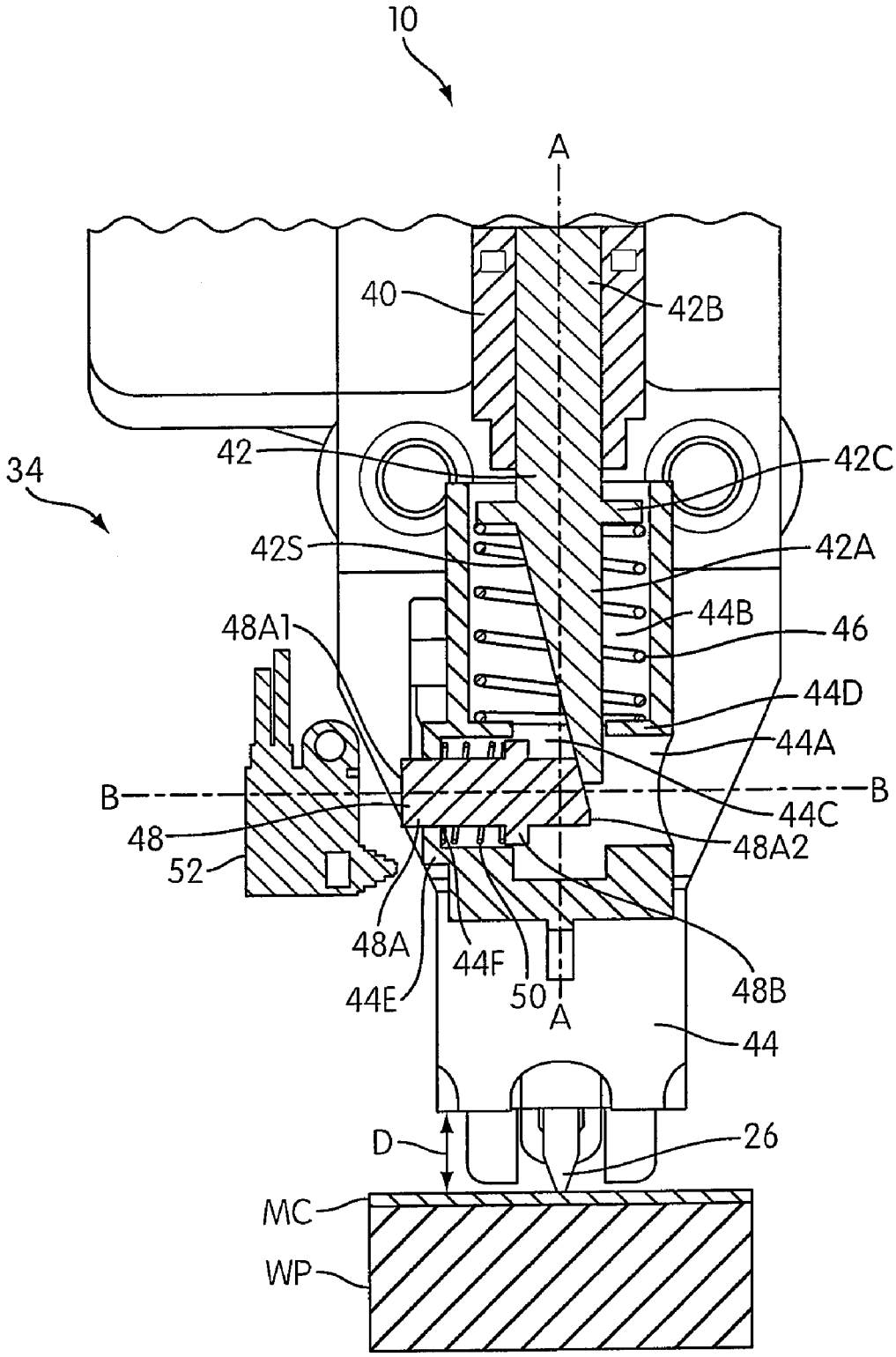
FIGS. 2A, 2B and 2C are cross-sectional views of the nose assembly of the fastener driving device depicted in FIG. 1, showing the contact trip assembly.
Figure 2B:
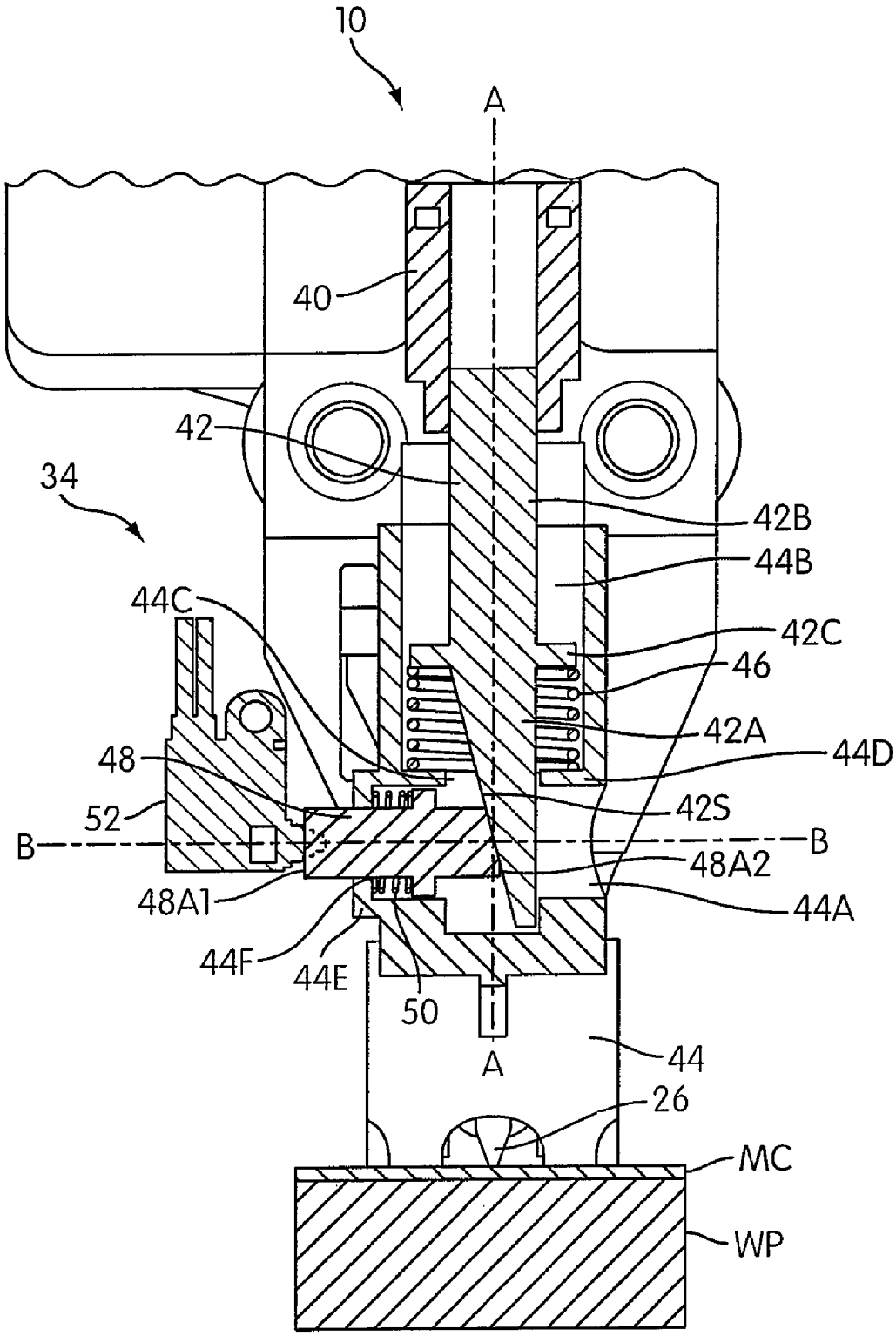
Figure 2C:
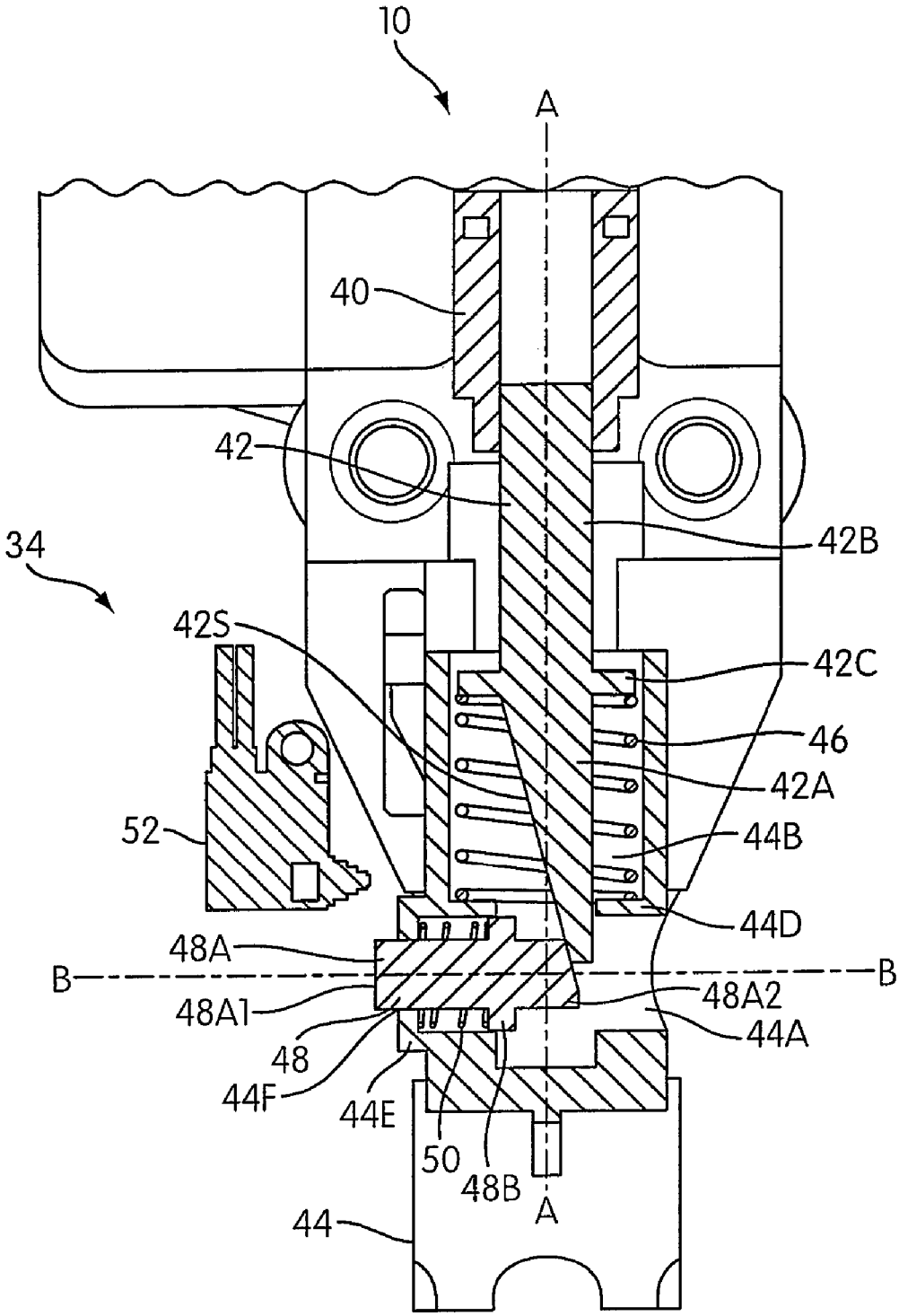

FIGS. 2A, 2B and 2C are cross-sectional views of the nose assembly 20 showing the contact trip assembly 34. The contact trip assembly 34 comprises an actuator 40 that is powered by electricity, i.e., an electrical actuator, and an upper trip portion 42 operatively coupled to the actuator 40. The actuator 40 is constructed and arranged to move the upper trip portion 42. In one embodiment, the actuator 40 is a solenoid. Although the actuator 40 will be described in the following paragraphs by referring to a solenoid, as it can be appreciated, the actuator 40 can be any other type of actuator that is configured to move the upper trip portion 42. For example, in another embodiment, the actuator 40 can include a motor wherein a rotary motion of the motor can be converted into a linear displacement via a screw and/or gears.

As illustrated, the solenoid 40 is connected to the fixed portion 21 of the nose assembly 20. As depicted in FIGS. 2A, 2B and 2C, the upper trip portion 42 of the contact trip assembly 34 has a slanted portion 42A, a straight portion 42B, and a transverse portion 42C generally perpendicular to the portions 42A and 42B. The straight portion 42B is operatively coupled to the solenoid 40. The slanted portion 42A has a cam surface 42S.

The contact trip assembly 34 further comprises a lower trip portion 44 movably mounted to the nose assembly 20. The lower trip portion 44 is configured to come in contact with the workpiece WP or the metal connector MC. The lower trip portion 44 includes two cavities 44A and 44B. The two cavities 44A and 44B communicate through opening 44C through which the slanted portion 42A extends to enter the cavity 44B. The contact trip assembly 34 further includes a first resilient member 46 that is disposed within the cavity 44B. One end of the resilient member 46 abuts a wall 44D in the cavity 44B and an opposite end of the resilient member 46 abuts to the transverse portion 42C of the upper trip portion 42. In this way, the resilient member 46 biases the upper trip portion 42 upwardly so that the straight portion 42B of the upper trip portion 42 to be lodged within a core of the solenoid 40.

The contact trip assembly further includes a plunger 48 movably disposed within the cavity 44A. The plunger 48 has a cross-like shape. The plunger 48 has first portion 48A and second portion 48B generally perpendicular to the first portion 48A. An end 48A1 of the portion 48A protrudes through an opening 44E of the cavity 44A and an opposite end 48A2 of the portion 48A is shaped (e.g., angled) to interact with the cam surface 42S of the slanted portion 42A of the upper trip portion 42. In one embodiment, the plunger 48 is disposed generally perpendicularly to the upper trip portion 42.

The contact trip assembly 34 further includes a second resilient member 50 which is disposed within the cavity 44A. One end of the resilient member 50 abuts a wall 44E in the cavity 44A and an opposite end of the second resilient member 50 abuts the portion 48B of the plunger 48. In this way, the resilient member 50 biases the plunger 48 towards the slanted portion 42A of the upper trip portion 42 so that the angled end 48A2 of the plunger 48 comes in contact with the cam surface 42S of the upper trip portion 42. As a result, when the upper trip portion 42 moves downwardly along axis AA, the slanted portion 42A of the upper trip portion 42 moves to push the plunger 48 along axis BB, generally perpendicular to axis AA, so that the end 48A1 of the plunger 48 protrudes further away from the wall 44E through an opening 44F in the cavity 44A. When the upper trip portion 42 moves upwardly along axis AA, the resilient member 50 pushes against the portion 48B to bias the angled end 48A2 of the plunger 48 towards the cam surface 42 S of the upper trip portion 42 and as a result the plunger 48 moves along axis BB to retract into the cavity 44A.

The contact trip assembly 34 further includes a trip switch 52 that is configured to be activated by the movable plunger 48. The trip switch 52 can be activated or not activated depending upon an excursion of the plunger 48 towards the trip switch 52. When the trip switch 52 is activated by the plunger 48, a signal is sent to a controller indicating that the engine may initiate a drive stroke.

When the fastener driving device 10 is at a rest position, the tip of the leading fastener 26 protrudes from an edge of the nose assembly 34. A user of the fastener driving device 10 utilizes the tip of the leading fastener 26 to locate the hole H in the metal connector MC. In operation, when the tip of the fastener 26 is disposed inside the hole H of the metal connector MC but the trigger 36 is not actuated, the upper trip portion 42 is biased by the resilient member 46 upwardly so that the straight portion 42B is forced within the core of the solenoid 40, as depicted in FIG. 2A. In this position, the plunger 48 is biased by the resilient member 50 towards the thinner part of the slanted portion 42A of the upper trip portion 42 so that the angled end 48A2 of the plunger 48 rests against the cam surface 42S of the upper trip portion 42. In this position, the plunger 48 does not protrude enough through the opening 44F to activate the trip switch 52.

In this position, the edge of lower trip portion 44 is spaced apart from the workpiece WP and/or metal connector MC by a predetermined distance D. The predetermined distance D may be zero or any value greater than zero, such as up to about 0.25 inch. For example, the predetermined distance D can be about 0.15 inch. The predetermined distance between the edge of the lower trip portion 44 allows a tip of the leading fastener 26 to be visible so that the leading fastener 26 may be used to identify the target position at which it should be driven.

When the tip of the leading fastener 26 is located inside the hole H of the metal connector MC and the workpiece WP is disposed below the lower trip portion 44, upon actuating the trigger 36, the solenoid 40 drives the upper trip portion 42 downwardly. Hence, the portion 42C of the upper trip portion 42 pushes against the upper end of the resilient member 46 with a certain force. The force is substantially transmitted to the lower end of the resilient member 46 due to the stiffness of the resilient member 46 which in turn moves the lower trip portion 44 downwardly by the distance D until the lower trip portion 44 reaches the metal connector MC or the workpiece WP, as depicted in FIG. 2B. When the lower trip portion 44 reaches the workpiece WP or the metal connector MC, the lower trip portion 44 stops moving. However, the upper trip portion 42 continues to move downwardly by compressing the resilient member 46. The downward movement of the upper trip portion 42 brings a thicker part of the slanted portion 42A against the end 48A2 of the plunger 48, thus forcing the plunger 48 out of the cavity 44A through the opening 44F towards the trip switch 52. When the end 48A1 of the plunger 48 reaches the trip switch 50, the trip switch 50 is activated. Upon activation, the trip switch 50 sends a signal to a controller (not shown) which signals the engine to thereby initiate a drive stroke to drive the fastener 26 through the hole H in the metal connector MC into the workpiece WP.

When the trigger 36 is actuated and the workpiece is located out of a range that the lower trip portion 44 can extend, the solenoid 40 drives the upper trip portion 42 downwardly. Hence, the portion 42C of the upper trip portion 42 pushes against the upper end of the resilient member 46 with a certain force. The force is substantially transmitted to the lower end of the resilient member 46 due to the stiffness of the resilient member 46 which in turn moves the lower trip portion 44 downwardly. Because the workpiece it out of range of the extent of the lower trip portion 44, the lower trip portion 44 will not contact or "sense" the workpiece WP and/or the metal connector MC. Hence, the lower trip portion 44 continues to move downwardly until it reaches its full extension, as depicted in FIG. 2C. In this condition, no counter reacting force is acted upon the lower trip portion 44 by the metal connector MC and/or the workpiece WP. Hence, the resilient member 46 is not compressed and the angled end 48A2 of the plunger 48 remains in contact with the cam surface 42S at the thin part of the slanted portion 42A of the upper trip portion 42. Consequently, the plunger 48 does not extend to activate the trip switch 52 and thus a fastener is not driven into the workpiece WP.

Figure 3:
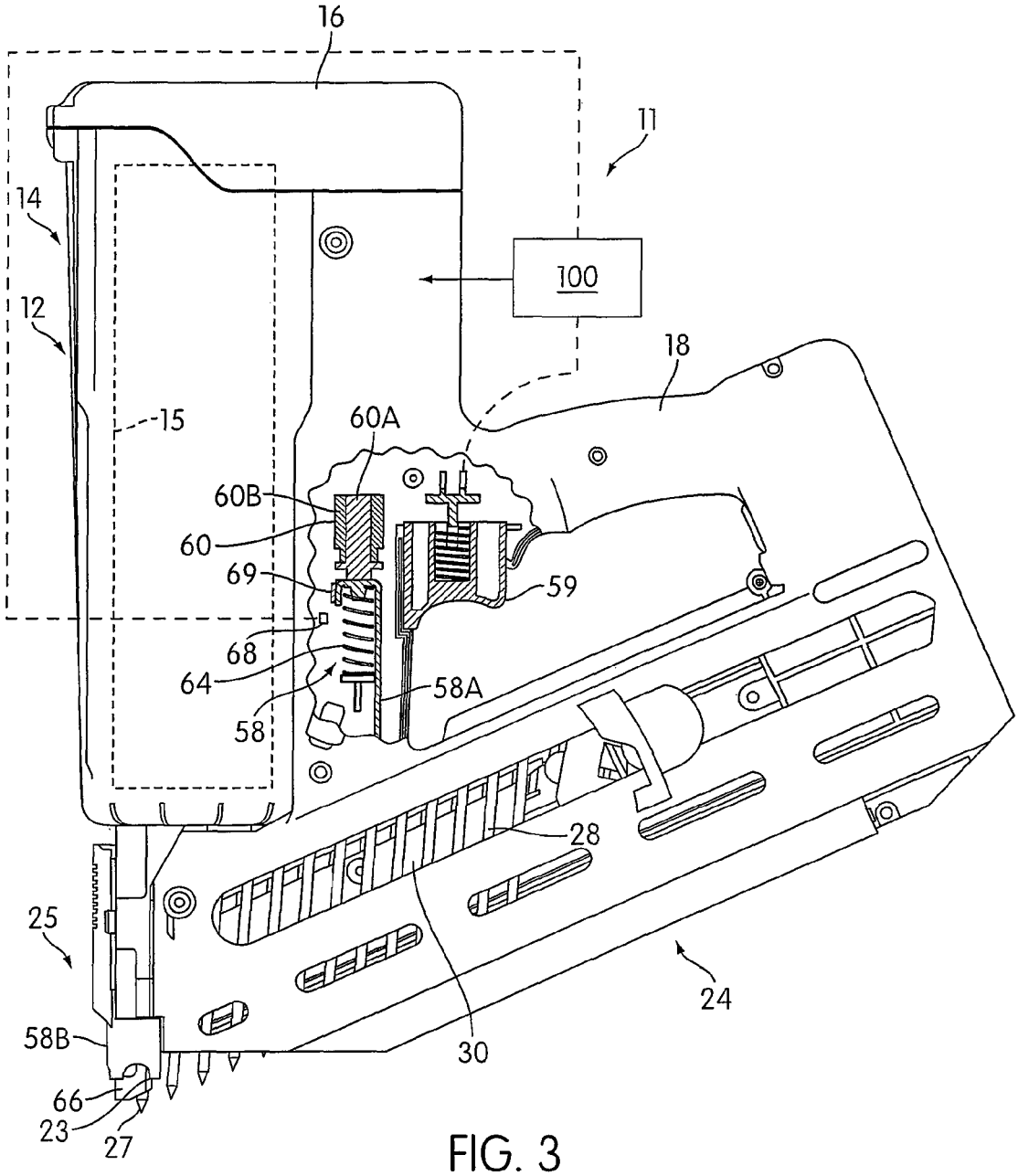
FIG. 3 is a broken-away side view of a fastener driving device showing a solenoid and a portion of the contact trip assembly, according to an embodiment of the present invention.

FIG. 3 is a broken-away elevational view of a fastener driving device, according to another embodiment of the present invention. The fastener driving device 11 is similar in many aspects to the fastener driving device 10. The device 11 includes a housing 12. The housing 12 includes an engine receiving portion 14 and a cap 16 that is connected to the engine receiving portion 14 at one end with a plurality of fasteners. The housing 12 also includes a handle 18 that extends from the engine receiving portion 14. As shown, the handle 18 may extend substantially perpendicularly from the engine receiving portion 14. The handle 18 is configured to be received by a user's hand, thereby making the device 11 portable.

The device 11 also includes a nose assembly 25 that is connected to the housing 12. The nose assembly 25 defines a fastener drive track 23 therein. A magazine assembly 24 is constructed and arranged to feed successive leading fasteners 27 from a supply of fasteners 28 contained therein along a feed track 30 and into the drive track 23. The magazine assembly 24 may also be connected to the handle 18. In the illustrated embodiment, the magazine assembly 24 is connected to the handle 18 at an end that is distal to the nose assembly 25, although it is also contemplated that the magazine assembly 24 may also be connected to the handle 18 in between its ends.

Similar to the fastener driving device 10, the fastener driving device 11 comprises a contact trip assembly 58. The contact trip assembly 58 is in communication with a controller 100 which communicates with the engine 15 that is located within the housing 12 of the fastener device 11. The fastener device 11 further includes a trigger 59 which is also in communication with the controller 100. Upon receiving a specific signaling sequence from the trigger 59 and the contact trip assembly 58, the controller 100 signals the engine to initiate a drive stroke.

Similar to contact trip assembly 34 in the fastener driving device 10, the contact trip assembly 58 of the fastener driving device 11 comprises an actuator 60 and an upper trip portion 58A operatively coupled to the actuator 60. However, in the fastener driving device 11, the actuator 60 is disposed in the vicinity of the trigger 59. The actuator 60 is constructed and arranged to move the upper trip portion 58A. In one embodiment, the actuator 60 is a solenoid. Although, the actuator 60 will be described in the following paragraphs by referring to a solenoid, as it can be appreciated the actuator 60 can be any other type of actuator that is configured to move the upper trip portion 58A. For example, in another embodiment, the actuator 60 can include a motor wherein a rotary motion of the motor can be converted into a linear displacement via a screw and/or gears.

In one embodiment, the solenoid 60 is mounted to the housing of the fastener driving device 11. The solenoid 60 comprises a solenoid shaft 60A arranged to move within a body 60B of the solenoid 60. A resilient member 64 (e.g., a spring) is provided to bias the solenoid shaft 60A to move upwardly into the body 60B of the solenoid 60. An upper trip portion 58A of a contact trip assembly 58 is operatively coupled to the solenoid shaft 60A. When an electrical current is passed through the solenoid 60, the solenoid shaft 60A is urged to move downwardly compressing the resilient member (e.g., spring) 64 and moving the upper trip portion 58A downwardly. When the electrical current is ceased, the resilient member 64 applies a biasing force to push the solenoid shaft 60A upwardly towards the solenoid body 60B and hence move upwardly the upper trip portion 58A. In an embodiment, the solenoid 60 may be of the spring return type in which a shaft biasing spring is provided within the solenoid body 60B and is configured to push the solenoid shaft 60A upwardly towards the solenoid body 60B. The spring 64 may still be used to bias the upper trip portion 58A upward.

The contact trip assembly 58 further comprises lower trip portion 58B movably mounted to the nose assembly 25. A linkage member may be provided to link the lower trip portion 58B to the upper trip portion 58A. The lower trip portion 58B is configured to come in contact with a workpiece WP or a metal connector MC (depicted in FIGS. 5B and 6B). The lower trip portion 58B is movable relative to a fastener guiding body 66 provided in the nose assembly 25 to guide the leading fastener 27 through a hole provided in the metal connector during a drive stroke.

The contact trip assembly 58 further includes a trip switch 68. In one embodiment, the trip switch is a Hall effect magnetic sensor or a Reed switch. In one embodiment, the trip switch 68 is configured to be activated by an activating element (e.g., a magnet) 69 coupled the upper trip portion 58A. In the following paragraphs, the activating element 69 will be referred to as a magnet 69, however, as it can be appreciated the activating element 69 can be any appropriate activating element that can be selected according to the type of trip switch 68 that is used. In one embodiment, the magnet 69 is mounted to an end of the upper trip portion 58A (for example at an end of an U-shaped upper trip portion 58A). The trip switch 68 is in communication with controller 100. The trip switch 68 can be activated when the magnet 69 is within an activation zone of the trip switch 68. For example, the trip switch 68 can be configured to be activated when the magnet 69 is substantially facing the trip switch 68.

Figure 4A:
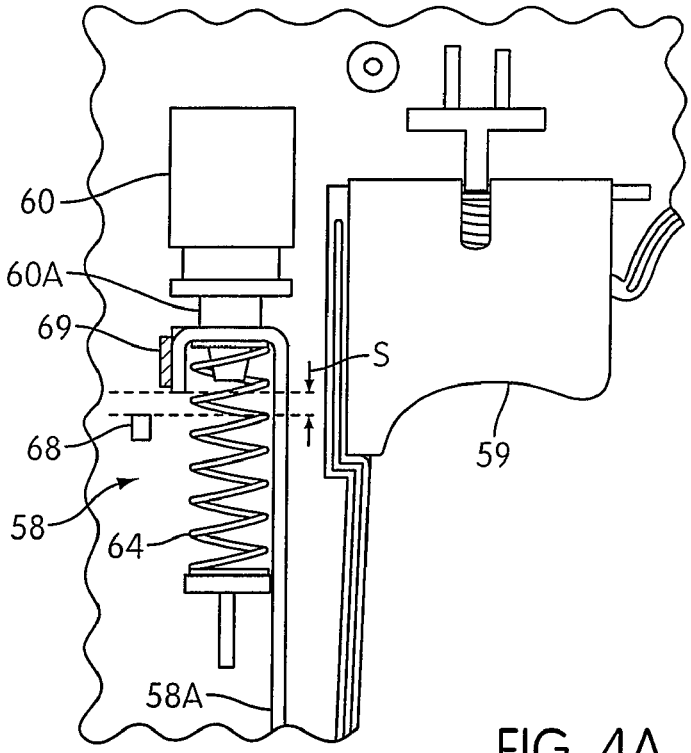
FIG. 4A is an enlarged view of the solenoid and an upper trip portion of the fastener driving device depicted in FIG. 3.
Figure 4B:
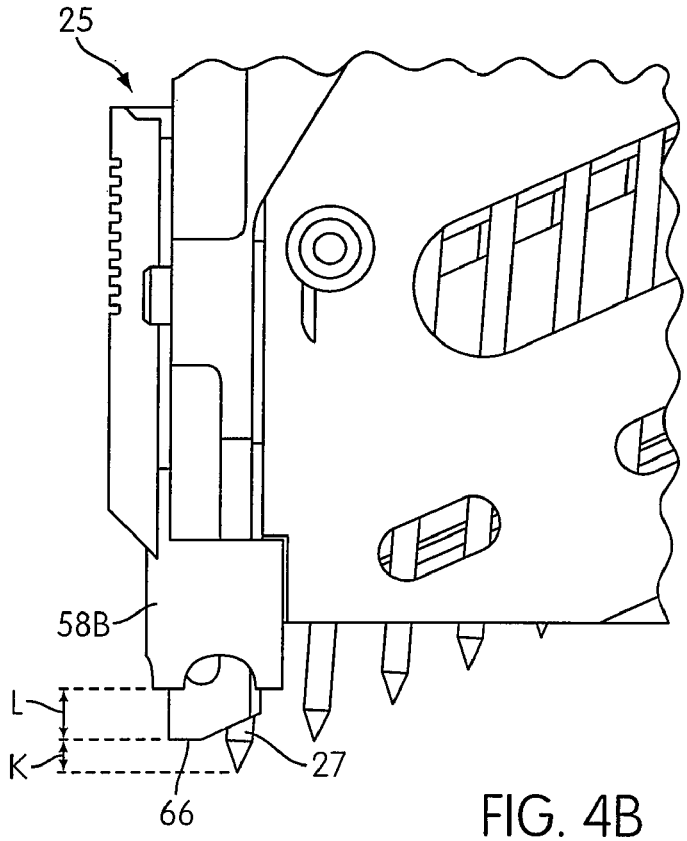
FIG. 4B depicts an enlarged view of the nose piece of the fastener driving device shown in FIG. 3.

FIG. 4A depicts an enlarged view of the solenoid 60 and upper trip portion 58A. FIG. 4B depicts an enlarged view of the nose assembly 25 of the fastener driving device 11 and the lower trip portion 58B. As shown in FIGS. 4A and 4B, when the fastener driving device 11 is at a rest position, the tip of the leading fastener 27 protrudes from an edge of the fastener guide body 66 of the nose assembly 25. At the rest position, the extremity of the lower trip portion 58B is spaced apart from the extremity of the fastener guide body 66 by a distance L and the tip of the leading fastener 27 protrudes from an edge of the fastener guide body 66 by a distance K. This allows the user to see the tip of the leading fastener 27. Therefore, a user of the fastener driving device 11 can utilize the tip of the leading fastener 27 to locate a hole H in the metal connector MC (shown in FIGS. 5B and 6B). At the rest position, no current is applied to the solenoid 60. Thus, the resilient member 64 biases the solenoid shaft 60A and the upper trip portion 58 coupled to the solenoid shaft 60A upwardly. In this position, the magnet 69 attached to an end of the upper trip portion 58A is spaced apart from the contact switch (e.g., a magnetic sensor) 68 by a distance S. The contact trip 68 can be calibrated such that at the distance S, the contact trip 68 does not sense the magnetic field generated by the magnet 69 and thus the contact switch 68 is not activated.

Figure 5A:
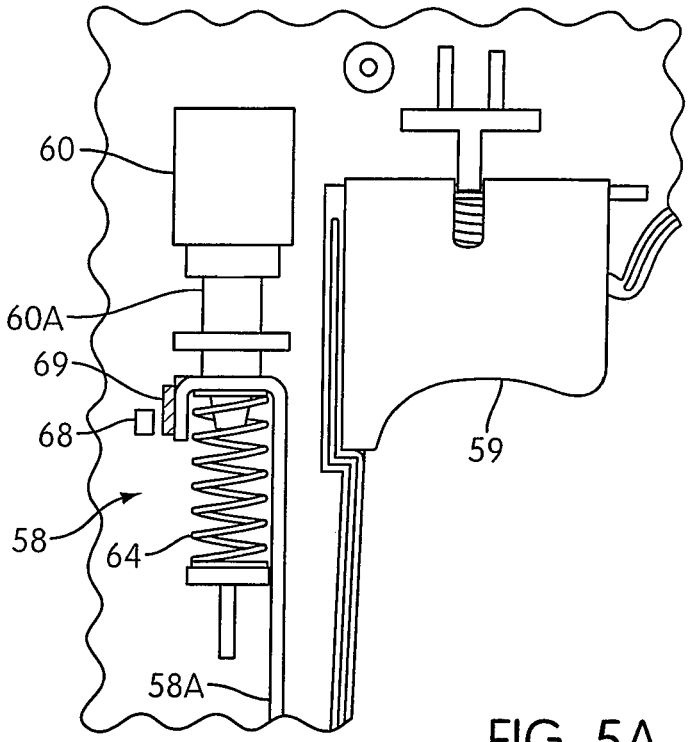
FIG. 5A is an enlarged view of the solenoid and upper trip portion of the fastener driving device shown in FIG. 3, showing another position of the upper trip portion.
Figure 5B:
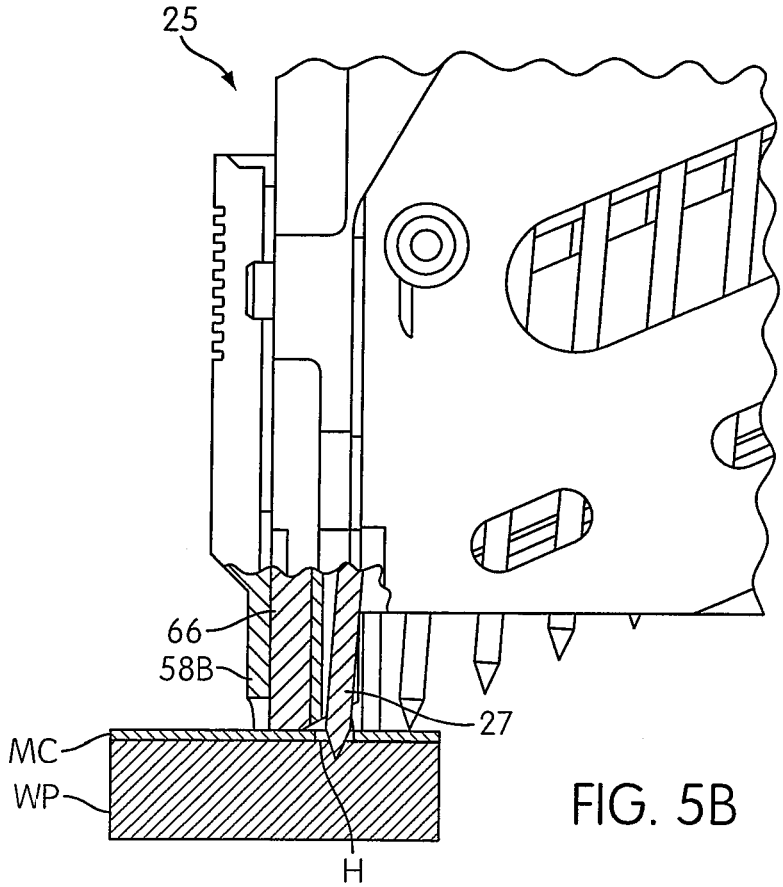
FIG. 5B is an enlarged view of the nose piece of the fastener driving device shown in FIG. 3, showing the tip of the leading fastener inserted through a hole in the metal connector into a workpiece.

FIG. 5A depicts an enlarged view of the solenoid 60 and upper trip portion 58A with the magnet 69 substantially facing the contact switch 68. FIG. 5B depicts an enlarged view of the nose assembly 25 of the fastener driving device 11 with the tip of the leading fastener inserted through a hole H in the metal connector MC into the workpiece. In operation, as depicted in FIGS. 5A and 5B, the tip of the leading fastener 26 is located inside the hole H of the metal connector MC and the tip of the nail is pushed against the workpiece WP to penetrate slightly the workpiece WP. FIG. 5B depicts the maximum nail penetration into the WP when the end of the fastener guide body 66 is contact with the metal connector MC. Upon actuating the trigger 59, an electrical signal is transmitted to the controller 100 indicating that the trigger is actuated. In addition, upon actuating the trigger 59, the solenoid 60 drives the solenoid shaft 60A and thus the upper trip portion 58A which is coupled to the solenoid shaft 60A downwardly. The lower trip portion 58B moves to follow the downward movement of the upper trip portion 58A. When the end of the lower trip portion abuts against the metal connector MC or the workpiece WP, the lower trip portion 58B stops and thus the upper trip portion 58A stops as well. As a result, the magnet 69 will stop at a position substantially facing or within a sensing perimeter of the contact switch 68. In this position, the contact switch 68 will be activated to generate an electrical signal that is transmitted to the controller 100 (shown in FIG. 3). If the controller 100 receives input signals from both the trigger 59 and the contact switch 68, the controller will generate an output signal that is transmitted to the drive engine to actuate the drive engine to drive the leading fastener 27 through the hole H in the metal connector MC into the workpiece WP.

Figure 6A:
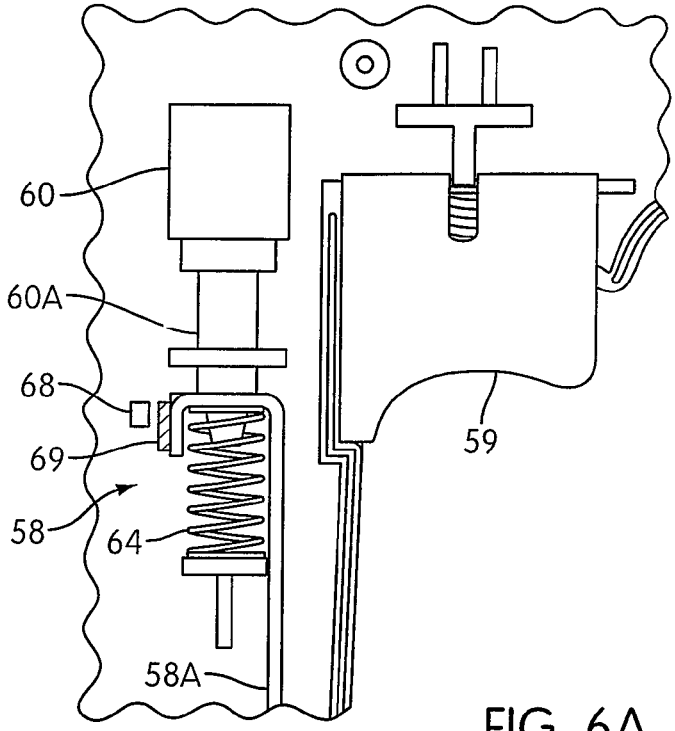
FIG. 6A is an enlarged view of the solenoid and upper trip portion of the fastener driving device shown in FIG. 3, showing another position of the upper trip portion.
Figure 6B:
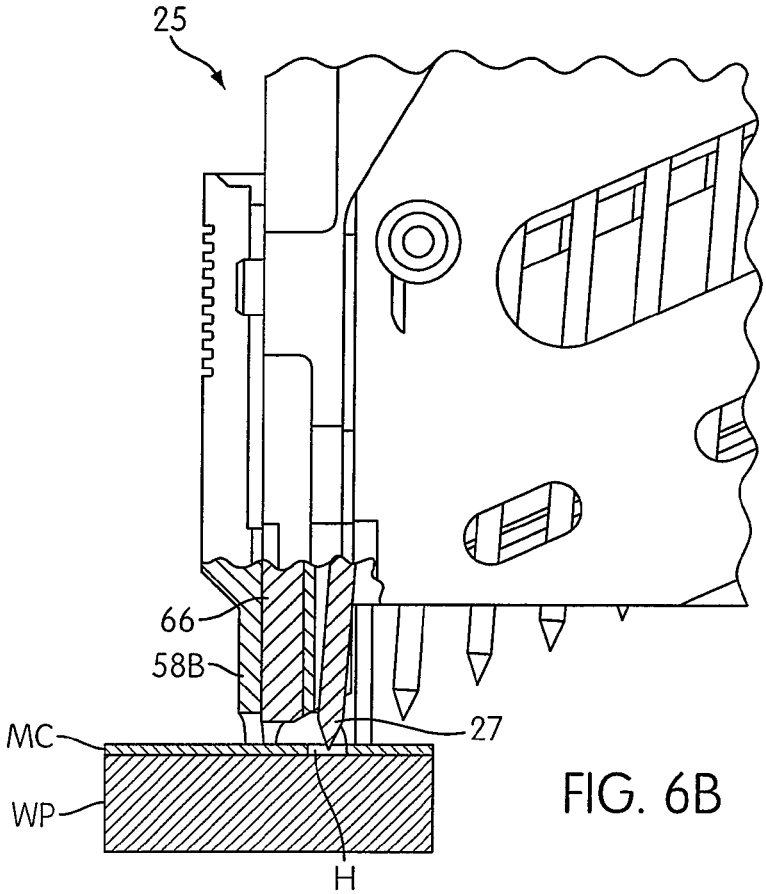
FIG. 6B is an enlarged view of the nose piece of the fastener driving device shown in FIG. 3 showing the tip of the leading fastener inserted through a hole in the metal connector.

FIG. 6A depicts an enlarged view of the solenoid 60 and upper trip portion 58A with the magnet 69 substantially facing the contact switch 68. FIG. 6B depicts an enlarged view of the nose assembly 25 of the fastener driving device 11 with the tip of the leading fastener 27 inserted through a hole H in the metal connector MC. As shown in FIG. 6B, the tip of the leading fastener 27 is inserted through the hole H in the metal connector but contrary to the what is shown in FIG. 5B, the tip of the leading fastener does not penetrate the workpiece WP. For example, this may be the case, when the workpiece WP is a relatively hard material. The operation of the fastener device 11 is similar to the operation described in the previous case (depicted in FIGS. 5A and 5B) where the tip of the leading fastener 27 penetrates the workpiece WP. However, it is worth noting that in the present case, because the tip of the leading fastener does not penetrate the workpiece WP, as a result, the lower trip portion 58B travels a longer distance than in the previous case (shown in FIGS. 5A and 5B) where the edge of the of the lower portion 58B travels beyond the end of fastener guide body 66. Because the lower trip portion 58B travels a longer distance, the upper trip portion also travels a longer distance. Therefore, care is taken to take into account this difference in distance so that the magnet 69 is within the sensing range of the contact switch 68 in both the instance where the tip of the leading fastener 27 penetrates the workpiece WP and the instance where the tip of the leading fastener 27 does not penetrate the workpiece WP. This can be achieved, for example, by providing a magnet 69 with a large enough extension or with multiple magnets so as to be within the sensing range of the contact switch 68 (e.g., facing the contact switch 68).

Figure 7A:
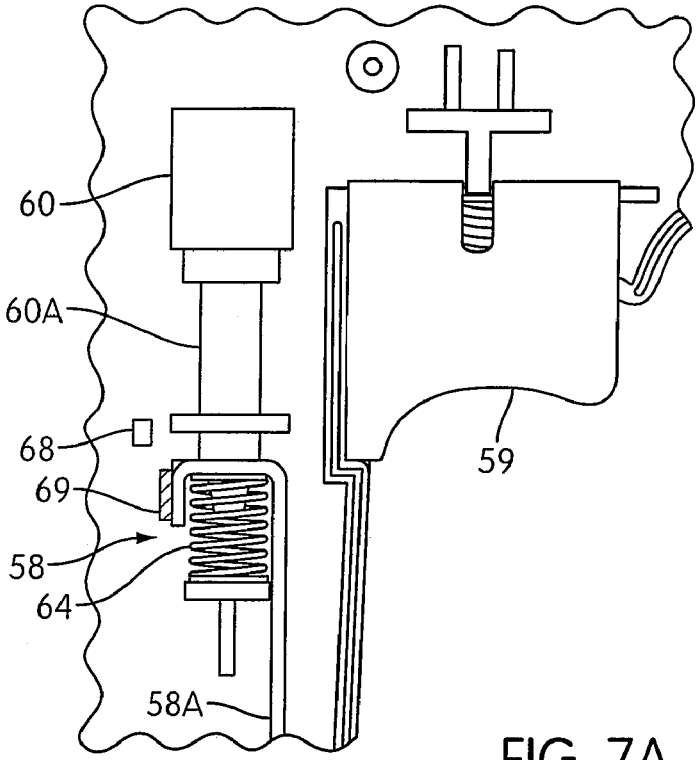
FIG. 7A is an enlarged view of the solenoid and upper trip portion of the fastener driving device shown in FIG. 3, showing yet another position of the upper trip portion.
Figure 7B:
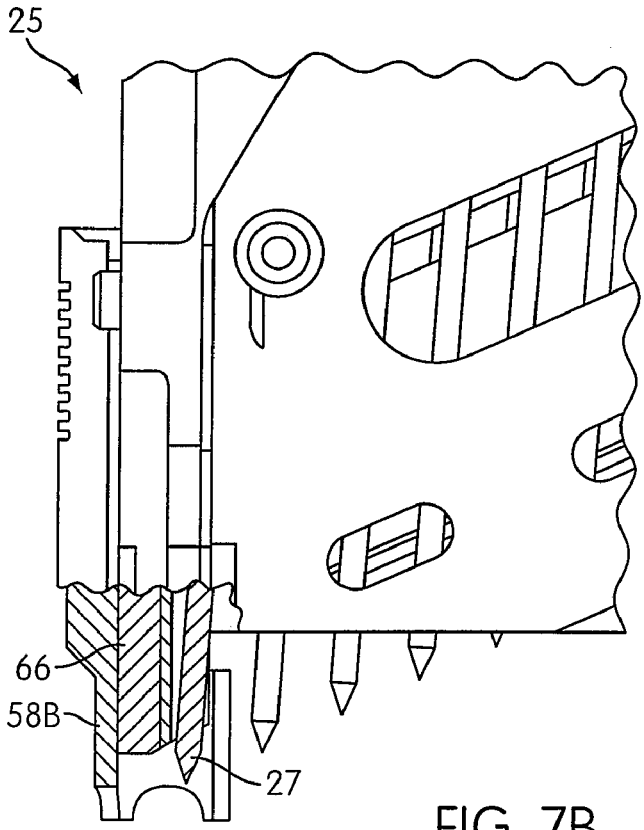
FIG. 7B is an enlarged view of the nose piece of the fastener driving device shown in FIG. 3 when the workpiece is out of range of travel of the contact trip.

FIG. 7A depicts an enlarged view of the solenoid 60 and upper trip portion 58A with the magnet 69 away from the contact switch 68. FIG. 7B depicts an enlarged view of the nose assembly 25 of the fastener driving device 11 when no workpiece WP is presented to the nose assembly 25 or when the workpiece WP is out of range of travel of the contact trip 58. As shown in FIGS. 7A and 7B, upon actuating the trigger 59, an electrical signal is transmitted to the controller 100 indicating that the trigger is actuated. In addition, upon actuating the trigger 59, the solenoid 60 drives the solenoid shaft 60A and thus the upper trip portion 58A which is coupled to the solenoid shaft 60A downwardly. The lower trip portion 58B moves to follow the downward movement of the upper trip portion 58A. Because the workpiece is out of range of the extent of the lower trip portion 58B, the lower trip portion 58B will not contact or "sense" the workpiece WP and/or the metal connector MC. Hence, the lower trip portion 58B continues to move downwardly until it reaches its full extension, as depicted in FIG. 7B. The upper trip portion 58A will follow the downward movement of the lower trip portion 58B. As a result, the magnet 69 will pass through the sensing region of the contact switch 68 but without remaining a period of time long enough in the sensing region of the contact switch 68 to activate the contact switch 68 or for the controller 100 to establish the presence of a steady signal from the contact switch 68. This can be performed by "debouncing" the switch 68 to ensure that the switch 68 outputs more than a short transient electrical signal (e.g., outputs a steady electrical signal with a minimum period of time) or by providing a time delay in the controller 100 from the actuation of the trigger 59 so that any potential short transient electrical signal is ignored by the controller 100. If the switch 68 outputs a transient electrical signal below a minimum value, the controller 100 may be configured to ignore the electrical signal. As a result, the controller does not transmit an output signal to actuate the drive engine and hence the leading fastener 27 will not be driven.

Figure 8:
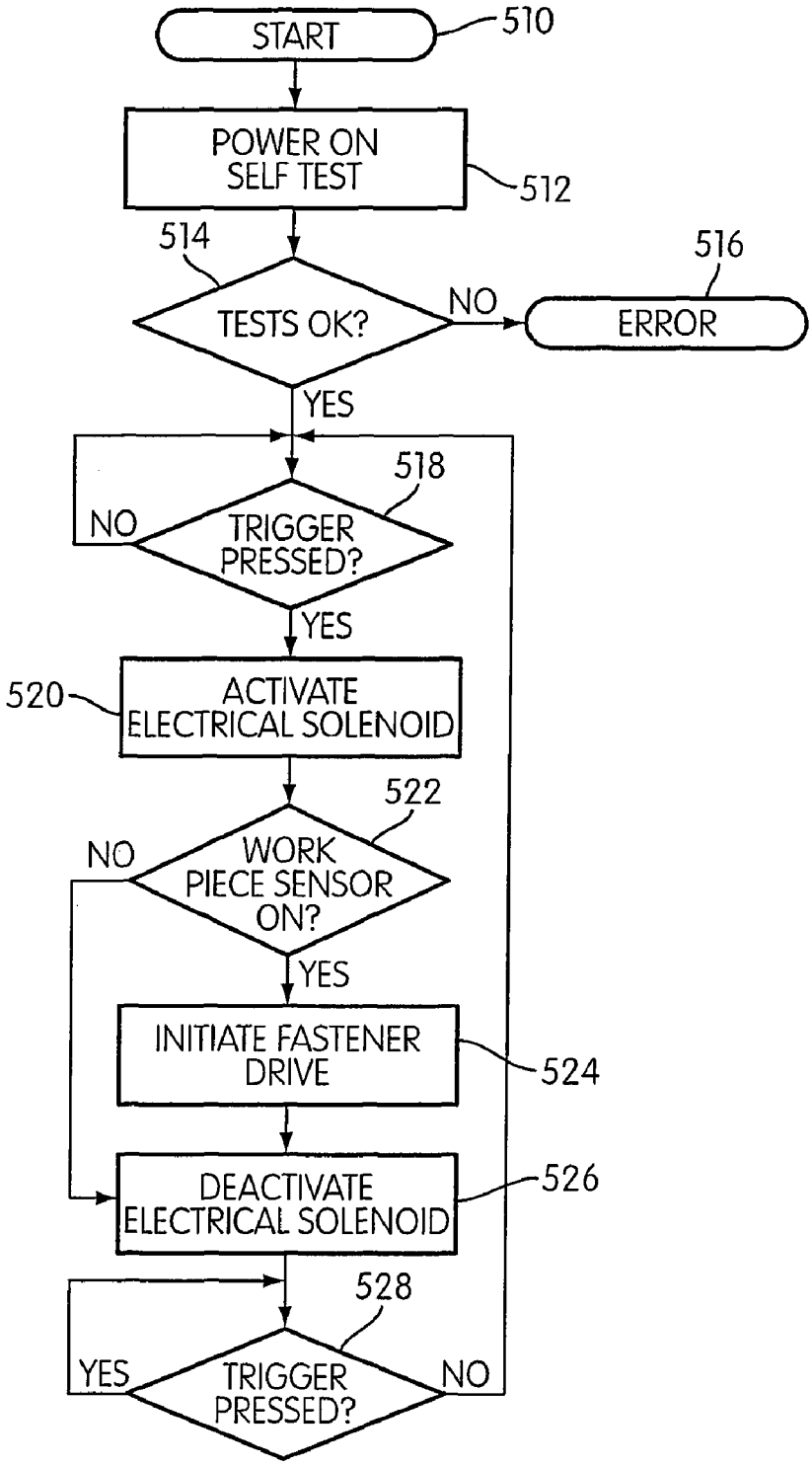
FIG. 8 is flow diagram of a method for operating the fastener driving device shown in FIG. 3, according to an embodiment of the present invention.

FIG. 8 is flow diagram of a procedure performed by the controller 100 for controlling the fastener driving device 11, according to an embodiment of the present invention. When a user switches on the fastener driving device 11 at step S10, the controller 100 tests various functions of the fastener driving device 11 at step S12. The controller 100 then checks whether all tests are successful, at S14. If one or more tests leads to an error, the user is warned of a presence of an error (for example via a light blinking sequence to indicate the type of error), at step S16. If the one or more tests does not lead to an error, the procedure continues. The controller 100 then checks whether the trigger 59 is actuated/pressed or not, at step S18. If the trigger 58 is not pressed, the controller waits until the trigger 58 is pressed. If the trigger 58 is pressed, the controller 100 activates the electrical solenoid 60 to drive the contact trip 58, at step S20. The controller 100 then checks if the contact switch (workpiece sensor) 68 is "ON", at step S22. That is, at step S22, the controller 100 checks whether an electrical signal is received from the switch 68. If the controller 100 does not receive a signal from the switch 68, i.e., the contact switch 68 is "OFF", the electrical solenoid 60 is deactivated, at step S26.

In one embodiment, if the controller 100 determines that a signal is received from the switch 68, the controller 100 further inquires if the received signal is not merely a short transient electrical signal by, for example, determining that the electrical signal received is steady for at least a certain period of time (e.g., the period of time being selected to be greater than a threshold time period of a short transient electrical signal generated if the magnet 69 merely passes through a sensing region of the switch 68). If the signal received by the controller 100 is an electrical signal having a time period greater than the threshold time period, the controller 100 outputs an electrical signal and transmits the signal to the drive engine to initiate a fastener drive stroke, at step S24. When the drive cycle is finished, the electrical solenoid 60 can be deactivated, at step S26.

In another embodiment, a time delay from the actuation of the trigger 59 can be provided in the controller 100 so that any potential short transient electrical signal is ignored by the controller 100. The time delay can be set to be equal to the time it takes the magnet 69 to reach and pass through the sensing range of switch 68 from the initial activation time of the electrical solenoid 60. In this case, if the controller 100 receives an electrical signal from the switch 68, the controller 100 outputs a control signal and transmits the signal to the drive engine to initiate a fastener drive. When the drive is finished, the electrical solenoid can be deactivated, at step 26.

The controller 100, then checks whether the trigger is pressed again, at S28. At Step S28, if the trigger 59 is still actuated, the controller S100 waits until the trigger is released to recycle the fastener driving device 11. If the signal received by the controller 100 is merely a short transient electrical signal, the controller 100 will not activate the drive engine to initiate a drive stroke. In this case, the controller 100 will deactivate the electrical solenoid 60, at Step S26. The controller 100 will then wait until the trigger is released to recycle the fastener driving device.

As would be appreciated by one of ordinary skill in the art, the device 10 of the present invention is suitable for many applications, as the ability to use the leading fastener to locate the precise location of the driven fastener may be desirable in application other than connecting metal connectors to workpieces. The operating range of the lower trip portion is desirably between being from flush with the nose to a predetermined distance beyond the nose, which may allow for reliable and seamless operability across a wide range of metal connector MC thicknesses and the variability of wood species, density, moisture content, etc.

Furthermore, as can be appreciated by one of ordinary skill in the art the use of the words upwardly and downwardly should not be construed as limiting as these words have merely been used in reference to the orientation of the fastener driving device shown in the present Figures. For example, the fastener driving device 10 can be held in another orientation other than the orientation shown in the present figures.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

It should be appreciated that in one embodiment, the drawings herein are drawn to scale (e.g., in correct proportion). However, it should also be appreciated that other proportions of parts may be employed in other embodiments.

Furthermore, since numerous modifications and changes will readily occur to those of skill in the art, it is not desired to limit the invention to the exact construction and operation described herein. Accordingly, all suitable modifications and equivalents should be considered as falling within the spirit and scope of the invention.

What is claimed is:

1. A fastener driving device comprising:

a housing;

a nose assembly carried by the housing, the nose assembly having a fastener drive track;

an engine carried by the housing and configured to drive a fastener out of the drive track and into a workpiece during a drive stroke;

a contact trip comprising an upper trip portion, a lower trip portion movably mounted to the nose assembly and operatively coupled to the upper trip portion, and an electrical actuator constructed and arranged to move the lower trip portion of the contact trip away from the housing; and a trigger configured to activate the electrical actuator to move the lower trip portion of the contact trip away from the housing.

2. The fastener driving device according to claim 1, wherein the electrical actuator comprises a solenoid configured to move the upper trip portion and the lower trip portion if the trigger is actuated.

3. The fastener driving device according to claim 2, wherein the contact trip further comprises a trip switch and a plunger operatively coupled to the upper trip portion, wherein if the workpiece is located within a range that the lower trip portion extends, the trip switch is actuated by the plunger that is moved by the upper trip portion causing the fastener to be driven into the workpiece.

4. The fastener device according to claim 3, wherein when the workpiece is not located within the range that the lower trip portion extends, the solenoid drives the upper trip portion and the lower trip portion downwardly, and the plunger does not actuate the trip switch.

5. The fastener driving device according to claim 4, wherein the contact trip further comprises a first resilient member constructed and arranged to bias the upper trip portion towards the solenoid.

6. The fastener driving device according to claim 5, wherein the contact trip further comprises a second resilient member constructed and arranged to bias the plunger towards the upper trip portion.

7. The fastener driving device according to claim 6, wherein the upper trip portion comprises a slanted portion and the plunger comprises an angled end, wherein the second resilient member is configured to bias the angled end of the plunger to come in contact with the slanted portion of the upper trip portion such that, when the slanted portion of the upper trip portion moves downwardly, the plunger moves generally perpendicularly to the upper trip portion.

8. The fastener driving device according to claim 2, wherein the contact trip further comprises a trip switch and an activating element operatively coupled to the upper trip portion, wherein the trip switch is configured to be activated by the activating element.

9. The fastener driving device according to claim 8, wherein if the workpiece is located within a range that the lower trip portion extends, the trip switch is activated by the activating element.

10. The fastener driving device according to claim 9, wherein if the trip switch is activated, the trip switch generates an electrical signal having a time period greater than a threshold time period of an electrical transient signal.

11. The fastener driving device according to claim 8, wherein when the workpiece is not located within the range that the lower trip portion extends, the solenoid drives the upper trip portion such that the activating element passes through a sensing region of the trip switch.

12. The fastener driving device according to claim 1, further comprising a magazine constructed and arranged to feed successive fasteners to the drive track, wherein the magazine is configured to position the fastener in the drive track such that a tip of the fastener in the drive track extends outwardly and away from the nose assembly before the fastener is driven by the engine.

13. The fastener driving device according to claim 1, wherein the contact trip further comprises a trip switch and an activating element configured to activate the trip switch when the workpiece is in front of the nose assembly.

14. The fastener driving device according to claim 13, further comprising a controller for controlling the operation of the fastener driving device, wherein the controller is configured to:

receive a signal from the trigger if the trigger is actuated, send a signal to the electrical actuator to move the contact trip if the trigger is actuated, receive a signal from the trip switch if the trip switch is actuated, and send a signal to the engine to initiate the drive stroke if the controller receives a signal from the trigger and receives a signal from the trip switch.

* * * * *